US006530314B1

(12) United States Patent
Sogaishi et al.

(10) Patent No.: US 6,530,314 B1
(45) Date of Patent: Mar. 11, 2003

(54) ELECTRIC PRESS WITH DUST GENERATION PREVENTING DEVICE

(75) Inventors: Ichiro Sogaishi, Tokyo (JP); Shunichi Okaya, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 216 days.

(21) Appl. No.: 09/605,788

(22) Filed: Jun. 27, 2000

(51) Int. Cl.[7] ..... B30B 9/30
(52) U.S. Cl. ..... 100/90; 100/240; 100/299
(58) Field of Search ..... 100/90, 240, 299

(56) References Cited

U.S. PATENT DOCUMENTS 4,108,063 A * 8/1978 Randolph ..... 100/215
5,517,908 A * 5/1996 Stout ..... 100/218

* cited by examiner

*Primary Examiner*—William Hong
(74) *Attorney, Agent, or Firm*—Nields & Lemack

(57) ABSTRACT

Disclosed is an electric press having a substantially airtight casing containing therein a drive device for reciprocatingly moving a ram relative to a work positioned on a base to press the work, and a device for exhausting the dusts produced within the casing from a room where the electric press is located to the outside into open air through a pipe connected to the casing, the electric press comprising dust exhausting means including at least two openings provided at the casing thereof, one of the openings being of a relatively small diameter to be used in connection with an exhauster of a normal level of exhausting ability and the other of the openings being of a relatively large diameter to be used in connection with an exhauster of a relatively low level of exhausting ability. Further the casing is divided into an upper portion and a lower portion, and the upper portion is detachably mounted to said lower portion. The dust exhausting means includes a sealing sheet of a property preventing dusts from passing therethrough, the sealing sheet has one end secured to the inside of the upper portion of said casing such that the free end of the sealing sheet extends down into the lower portion of said casing all therearound to close a clearance between the upper portion and the lower portion, said sheet being yielding to the exhausting force of said exhauster to allow outer air to flow into said casing through the clearance when the exhauster is operated.

3 Claims, 6 Drawing Sheets

ELECTRIC PRESS WITH DUST GENERATION PREVENTING DEVICE

BACKGROUND OF THE INVENTION

1. Field of the Invention

The invention relates to an electric press, and more particularly relates to an electric press provided with a device for preventing the electric press from generating dusts in a room where the electric press is located while the electric press is operated. The electric press is relatively simple in structure and is adapted to being used in a clean space factory and/or a product studying and researching room where the space is made clean.

2. Prior Art

So far, there has not been proposed an electric press provided with a device for preventing the electric press from generating dusts in a room where the electric press is located while the electric press is operated.

It is admitted that some industrial robots have been provided with a dust generation preventing device. However, such dust generation preventing device has been generally lacked in adaptation to the customer's requirements.

Now a clean electric press is demanded, which will not produce dusts in a room where the press is used. Such an electric press is required to have an optimum exhaust power which will produce an exhaust flow matching the amount of dusts generated in the electric press.

In case the electric press is provided with an exhaust port of large diameter, an exhauster of relatively high exhaust ability or relatively low exhaust ability may be used to exhaust a required amount of dusts.

However, if the exhaust port is of large diameter, it is required that the hoses and pipes to be used in connection with the exhaust port are of so large diameter. This will extremely restrict the design and arrangement of the press body, pipes and wiring. It is, therefore, desired to make the exhaust port small.

On the other hand, if the exhaust port is small, an exhauster of relatively low exhaust ability is not sufficient a required amount of dusts. It is, therefore, required to provide another exhaust port of relatively large diameter which may be alternatively used with the small exhaust port.

Since the electric press is used in a clean room to exhaust the dusts generated in the press to the outside of the room into the open air, the electric press is not required to be completely airtight. However, a small gap or clearance of the electric press will allow a small amount of dusts to flow out through the gap when the electric press is operated while the exhauster is inoperative condition.

In the room requiring a high level of cleanliness, the electric press releasing the dusts, even if in small amount, is not desirable. Therefore, an electric press is desired, which will release no dusts even if it is operated while the exhauster is inoperative condition.

OBJECTS OF THE INVENTION

It is, therefore, an object of the invention to provide an electric press provided with a dust generation preventing device adapted to being used in a clean room.

It is another object of the invention to provide an electric press which is compact in structure and effective in operation.

It is another object of the invention to provide an electric press which may be used in combination alternatively with an exhauster of relatively high exhaust ability and an exhauster of relatively low exhaust ability in dependence upon the operation mode of the electric press.

It is still another object of the invention to provide an electric press which will not release dusts if it is operated while the exhauster is inoperative condition.

SUMMARY OF THE INVENTION

For attaining the objects, the electric press comprises a substantially airtight casing containing therein a drive device for reciprocatingly moving a ram relative to a work positioned on a base to press the work, and a device for exhausting the dusts produced within the casing from a room where the electric press is located to the outside into open air through a pipe connected to the casing, dust exhausting means including at least two openings provided at the casing thereof, one of the openings being of a relatively small diameter to be used in connection with an exhauster of a normal level of exhausting ability and the other of the openings being of a relatively large diameter to be used in connection with an exhauster of a relatively low level of exhausting ability. Further the casing is divided into an upper portion and a lower portion, and the upper portion is detachably mounted to said lower portion. The dust exhausting means includes a sealing sheet of a property preventing dusts from passing therethrough, the sealing sheet has one end secured to the inside of the upper portion of said casing such that the free end of the sealing sheet extends down into the lower portion of said casing all therearound to close a clearance between the upper portion and the lower portion, said sheet being yielding to the exhausting force of said exhauster to allow outer air to flow into said casing through the clearance when the exhauster is operated.

DETAILED DESCRIPTION OF THE PREFERRED EMBODIMENT

Figure 1:
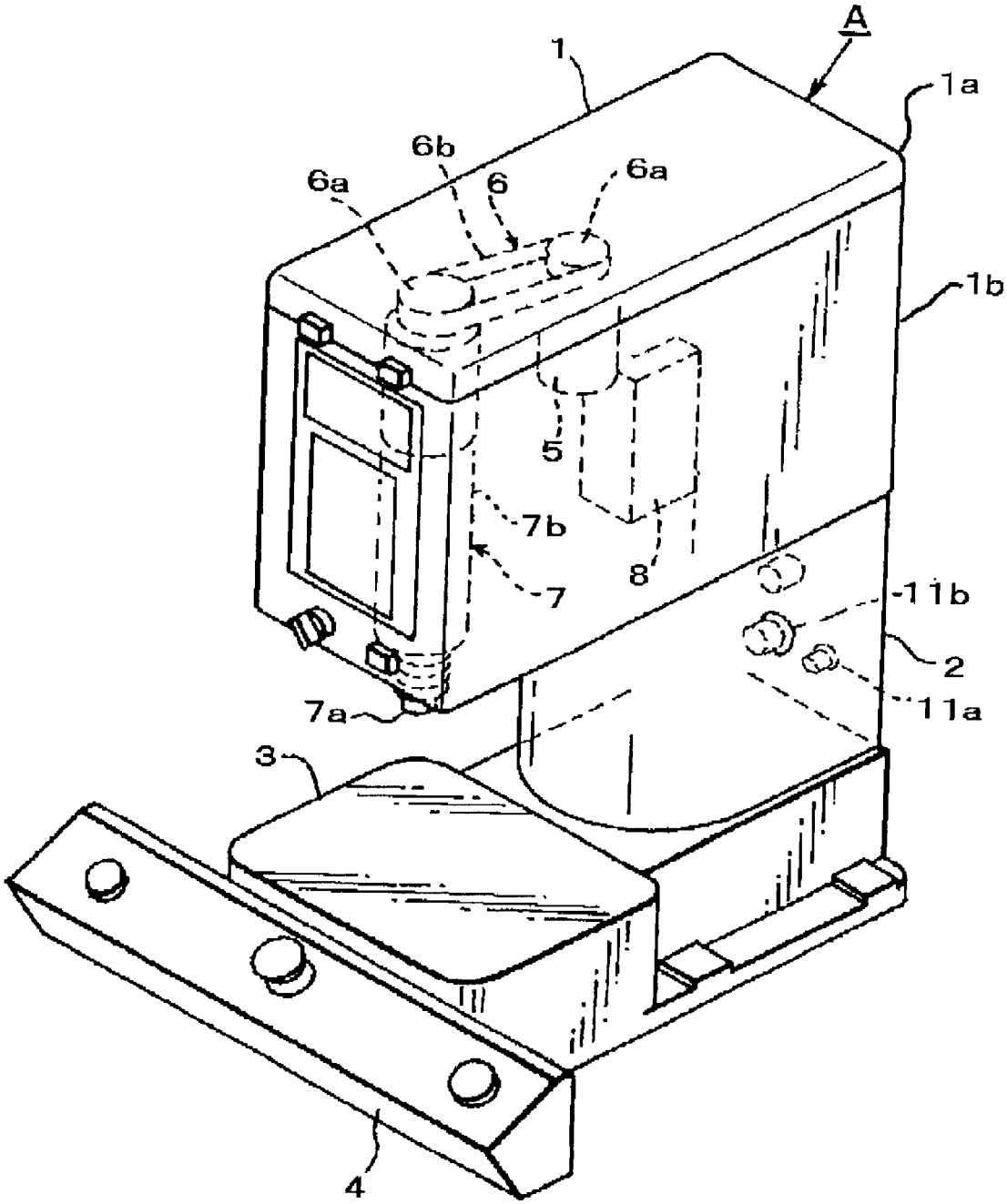
FIG. 1 is a perspective view from one direction of an electric press according to the invention.
Figure 2:
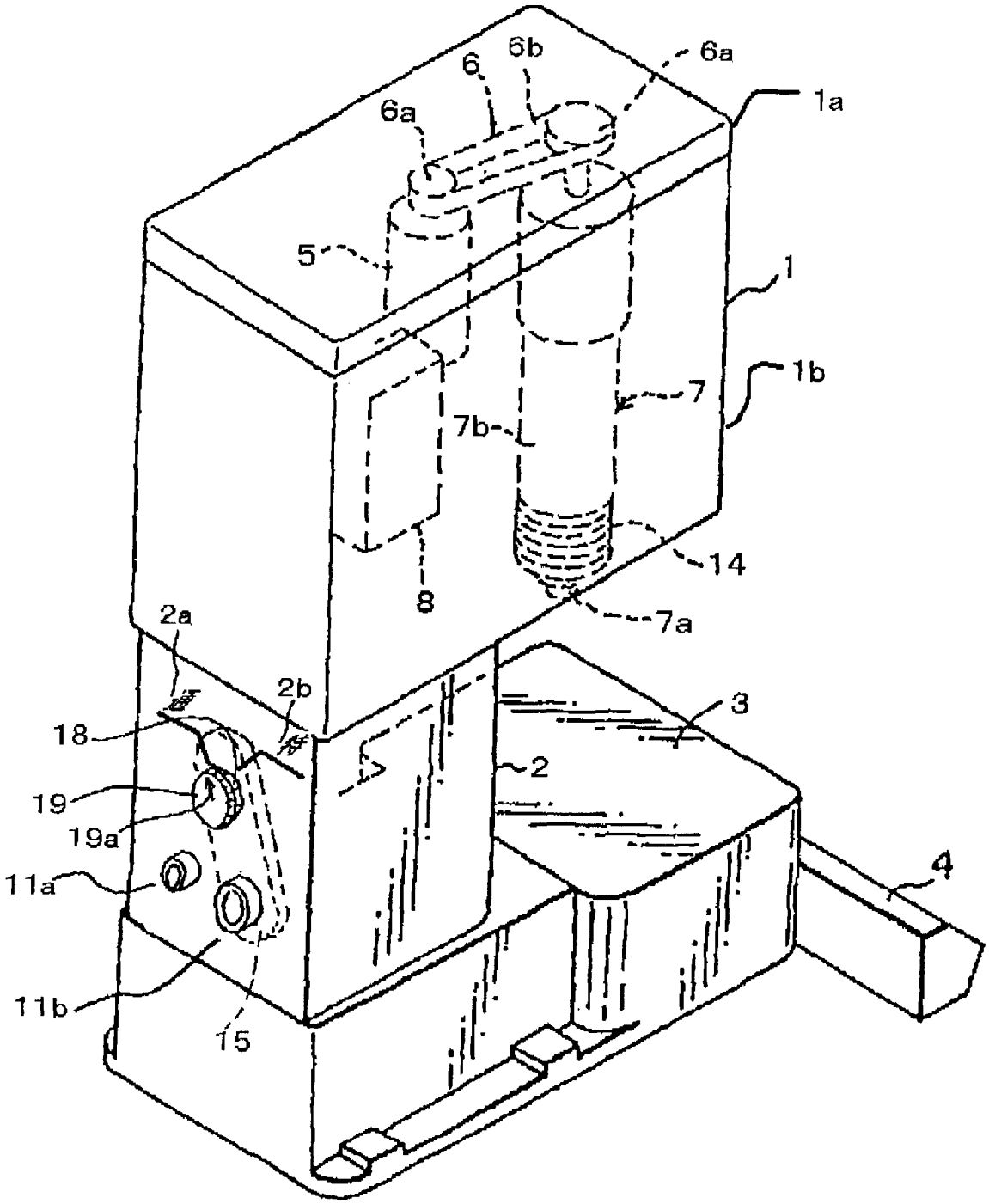
FIG. 2 is a perspective view from another direction of the electric press.

The invention will now be described in reference to the attached drawings. In FIGS. 1 and 2, the electric press of the invention is substantially composed of an airtight casing A and a working bed 3 for supporting a work thereon to be pressed. The airtight casing A includes a head portion 1 for containing therein the essential parts of the electric press and a column portion 2 which is extended between the head portion 1 and the working bed 3.

The head portion 1 has an operation board provided on the front side thereof. The head portion 1 and the column portion 2 are designed to have a sufficient rigidity. The joints between the head portion 1 and the column portion 2 and between the column portion 2 and the working bed 3 are substantially sealed.

A controller 4 is provided on the front side of the working bed 3. The head portion 1, the column portion 2 and the working bed 3 are assembled as being sealed so as to be substantially airtight.

The casing A contains therein the essential parts including a drive portion 5, a transmission portion 6, a pressing portion 7 and a control portion 8. The drive portion 5 includes a servomotor. The transmission portion 6 includes pulleys 6*a* and a transmission belt 6*b* extended around the pulleys 6*a* for transmitting mechanical power from the drive portion 5 to the pressing portion 7.

The pressing portion 7 includes a ram 7*a,* and a drive portion 7*b* for vertically reciprocating the ram 7*a* to pressingly process a work positioned on the working bed 3. The ram drive portion 7*a* is generally cylindrical and contains therein an elongated threaded member provided with ball bearings which is operatively connected to the ram 7*a* and is rotated to be axially reciprocated, thereby to vertically move the ram 7*a* with a stroke S as shown in FIG. 3.

The pressing portion 7 is covered with a vertically flexible dust boot 14 which as has an upper end sealingly connected to the lower end of the casing A and has a lower end sealingly connected to the ram 7*a* such that the dust boot 14 may be vertically flexible as the ram 7*a* is vertically moved, thereby to prevent the dusts from coming out of the casing A while the ram 7*a* is vertically moved.

The column 2 has openings 11*a,* 11*b* provided at one side thereof so that an exhaust pipe may be connected to one of the openings.

Figure 3:
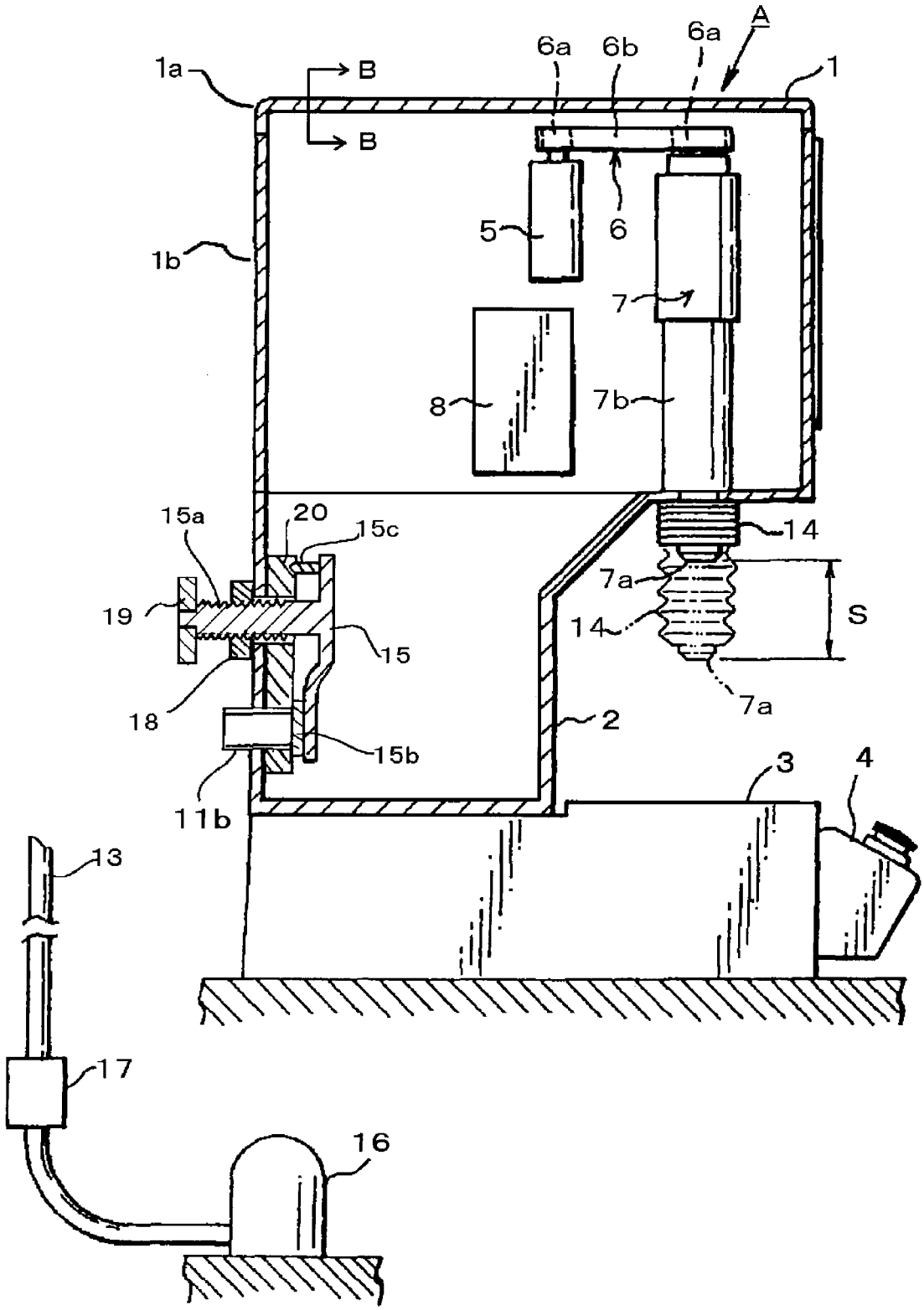
FIG. 3 is a side elevational view of the electric press shown in vertical section.

As shown in FIG. 3, the exhaust pipe 13, which is partly shown, has one end to be connected to any one of the openings 11*a,* 11*b* and has the opposite end connected to a blower 16 which is located outside of the clean room where the electric press is located. The blower 16 is operated to absorb the dusts from the casing A through the exhaust pipe 13 and release the dusts to the open air while the electric press is operated. Since the casing A is airtight as mentioned hereinbefore, the dusts in the casing A will not come out of it. A flow meter 17 may be provided at the exhaust pipe 13.

Regarding the openings 11*a,* 11*b* provided at one side of the column 2, the opening 11*a* is normally used to exhaust the dusts from the casing A and is designed to have a relatively small diameter, for example, about 8 mm (inner diameter) which is sufficient to obtain a required exhaust amount, for example, 100 NI/min while a blower of a standard exhaust ability, for example, 900 NI/min is used. This is because the column 2 may have electric wiring portions and connecting cords provided on the outer surface thereof.

The opening 11*b* is designed to have a relatively large diameter provided for adaptation to an exhauster of relatively low exhaust ability. The diameter is, for example, about 25 mm (inner diameter) which is sufficient to obtain a required exhaust amount, for example, 100 NI/min while a blower of low exhaust ability, for example, 500 NI/min is used.

For exhausting the dusts from the casing A, one of the openings 11*a,* 11*b* is selectively used in dependence upon the exhaust ability of exhauster while the other of the openings is closed. As shown in FIGS. 2 and 3, the openings 11*a,* 11*b* may be alternatively closed by a plate which may be rotatable between two positions. More precisely, a support plate 20 having the opening elements 11*a,* 11*b* supported thereon is secured to the column 2 on the inner wall thereof with the opening elements 11*a,* 11*b* being partly protruded out of the column 2 so as to be connected to the corresponding exhaust pipes respectively. A closing plate 15 is provided inside of the column 2. The closing plate 15 has a laterally extended shaft 15*a* which is partly protruded out of the column 2 through the support plate 20 and the side wall of the column 2. The protruded end portion of the shaft 15*a* is threaded so as to be in engagement with a nut 18 which is tightened to fixedly support the closing plate 15 on the column 2. The closing plate 15 has a rubber plate 15*b* provided at the lower end thereof which may selectively close one of the openings 11*a,* 11*b* when the closing plate 15 is set to one of the two positions. Further the closing plate 15 has a laterally extended pin 15*c* which may selectively engage one of spaced recesses formed at the support plate 20 to fixedly support the closing plate 15 on the column 2 in cooperation with the nut 18. Further a dial 19 is mounted to the protruded end of the shaft 15*a* of the closing plate 15.

In order to selectively use one of the openings 11*a,* 11*b,* at first, the nut 18 is loosened to enable the closing plate 15 to be axially movable. Subsequently the dial 19 is pressed to axially move the closing plate 15, thereby to disengage the positioning pin 15*c* from one of the recesses of the support plate 20 and simultaneously disengage the rubber plate 15*b* from one of the openings 11*a,* 11*b*. The closing plate 15 is then rotated to bring the positioning pin 15*c* to the other of the recesses in reference to an arrow 19*a* marked on the dial 19 and two space marks 2*a,* 2*b* provided on the column 2 which indicate the two recesses respectively and are selectively pointed by the arrow 19*a*. With the arrow 19*a* being in alignment with the one of the marks 2*a,* 2*b,* the nut 18 is tightened fix the closing plate 15. Thus the openings 11*a* or 11*b* are selected.

In an alternative way, one of the openings 11*a,* 11*b* which is not used may be closed by a cap. Further in another way, the closing plate 15 may be replaced with a plate which may be slidingly moved relative to the openings 11*a,* 11*b* to selectively close the opening which is not used.

In case the casing A includes the elements other than the head portion 1 and the column portion 2, the jointed portions are all sealed to make the casing airtight.

Figure 4:
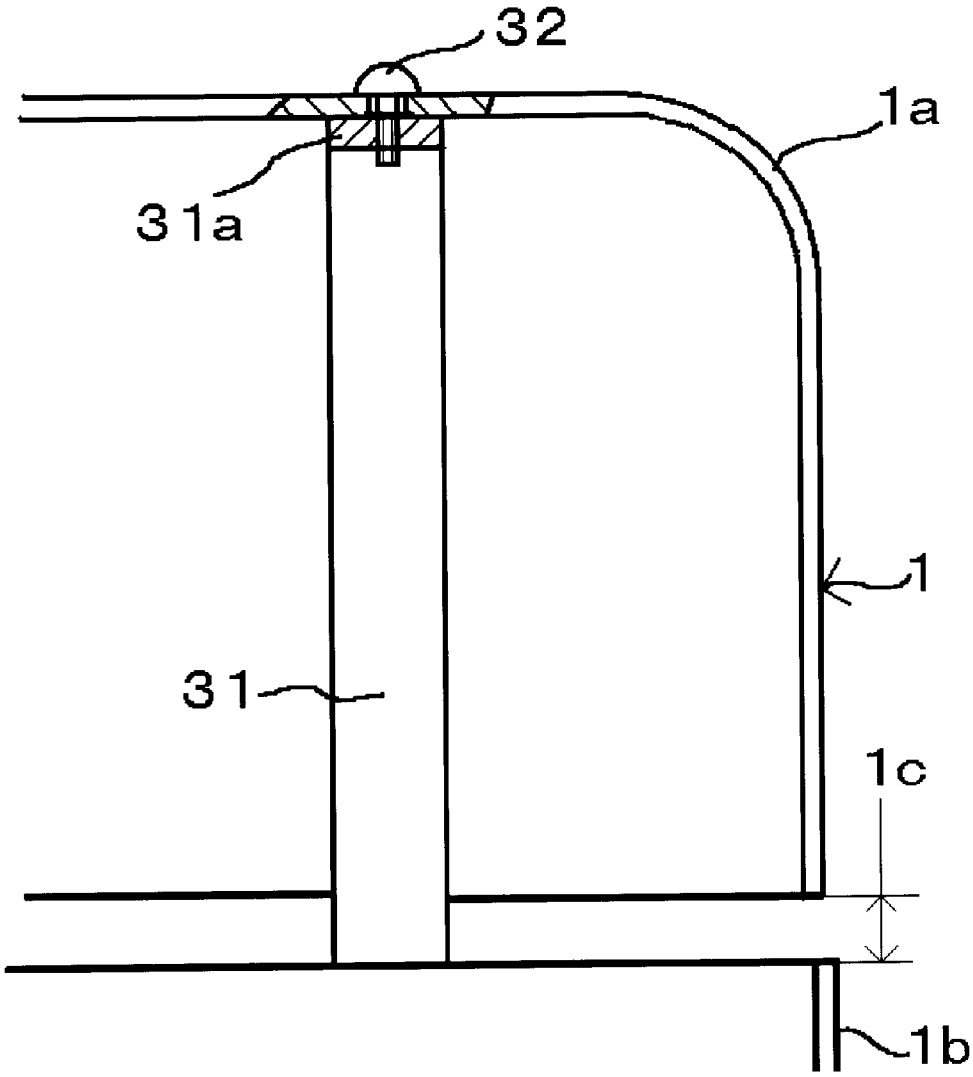
FIG. 4 a side elevational view of the electric press taken along the line B—B of FIG. 3.
Figure 5:
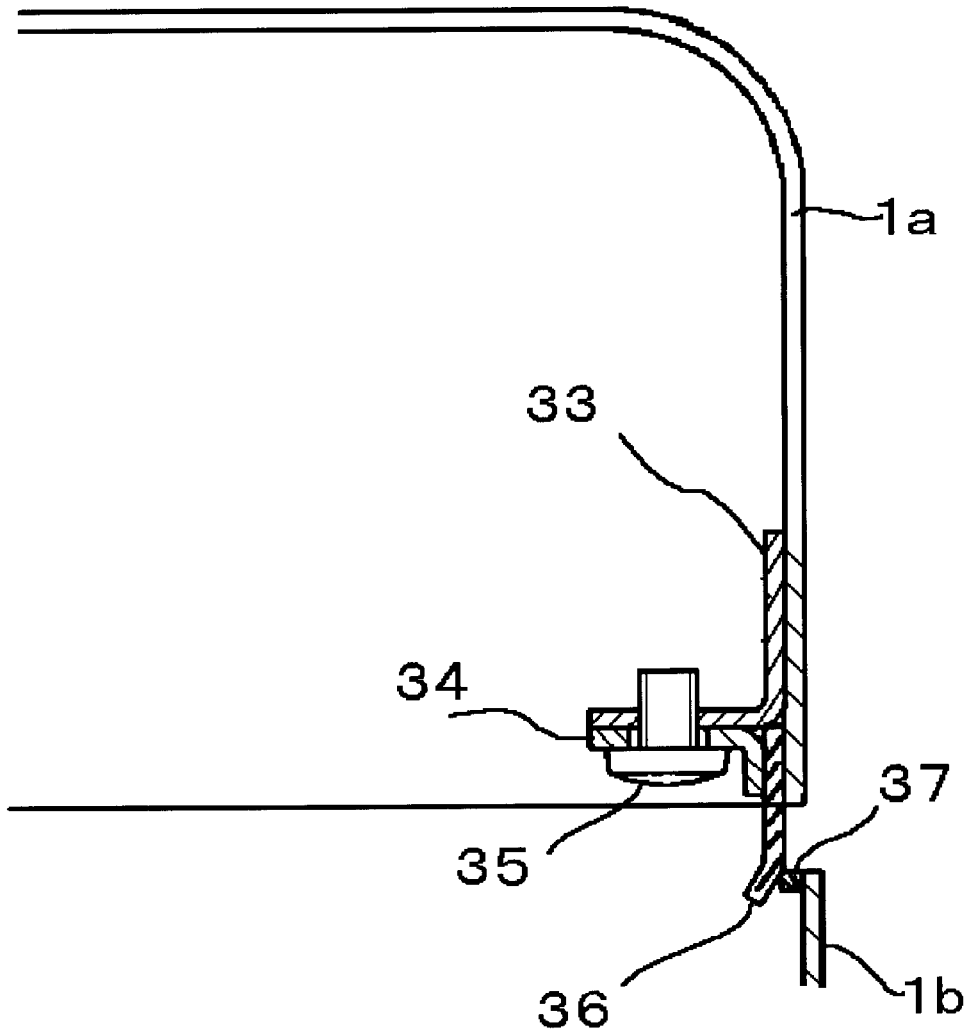
FIG. 5 is a side elevational view of a part the electric press shown in vertical section.

FIGS. 4 and 5 show the details of the casing A which is composed of an upper portion 1*a* as a cover and a lower portion 1*b* so as to make easy the assembling and maintenance operations of the electric press.

FIGS. 4 and 5 show the sectioned views taken along the line B—B.

In FIG. 4, a plurality of frames, though only one frame 31 is shown, the frame 31 is formed in a U-shape having upper and lower opposite flat portions. The lower flat portion is secured to the lower portion 1*b* of the casing A and stands up therefrom. The upper flat portion 31*a* has a threaded hole (or threaded holes) provided thereat.

The upper portion 1*a* of the casing A which is formed as a cover is secured to the frame 31 by means of a screw 32 which is extended through the top of the cover 1*a* and is threaded into the threaded hole of the frame 31. According to the assembling method, it is unavoidable to produce a slight clearance, for example, the clearance 1*c* between the lower end of the cover 1*a* and the upper end of the lower portion 1*b*. Even if the lower end of the cover 1*a* is designed to cover all around the upper portion of the lower portion 1*b,* another type of clearance will be produced between the cover 1*a* and the lower portion 1*b*.

The cover 1*a* has a sectionally L-shaped support plate 33 secured to the inside thereof. A sealing sheet 36 is secured to the support plate 33 by an auxiliary plate 34 which is fixedly attached to the support plate 33 by means of a screw

35. The sealing sheet 36 is extended down to the inside of the lower portion 1*b* of the casing A to close the clearance 1*c* (FIG. 4). The sealing sheet 36 may be made of a soft rubber or a soft resin which will not allow the dusts to pass therethrough.

The lower portion 1*b* of the casing A has an edge 37 provided at the upper part thereof and directed inside thereof such that the sealing sheet 36 may be normally in contact with the edge 37 and close the clearance 1*c* in cooperation with the edge 37.

Therefore, the sealing sheet 36 will normally prevent the dusts from coming out of the casing A into the clean room where the electric press is located. In case the blower 16 is operated while the electric press is in operation, a minus pressure generated within the casing A will move the sealing sheet 36 inwardly of the casing A to allow the open air to flow into the casing A through the clearance 1*c*. Thus the load applied to the blower 16 is decreased while the mechanical elements within the casing A are cooled down.

Figure 6:
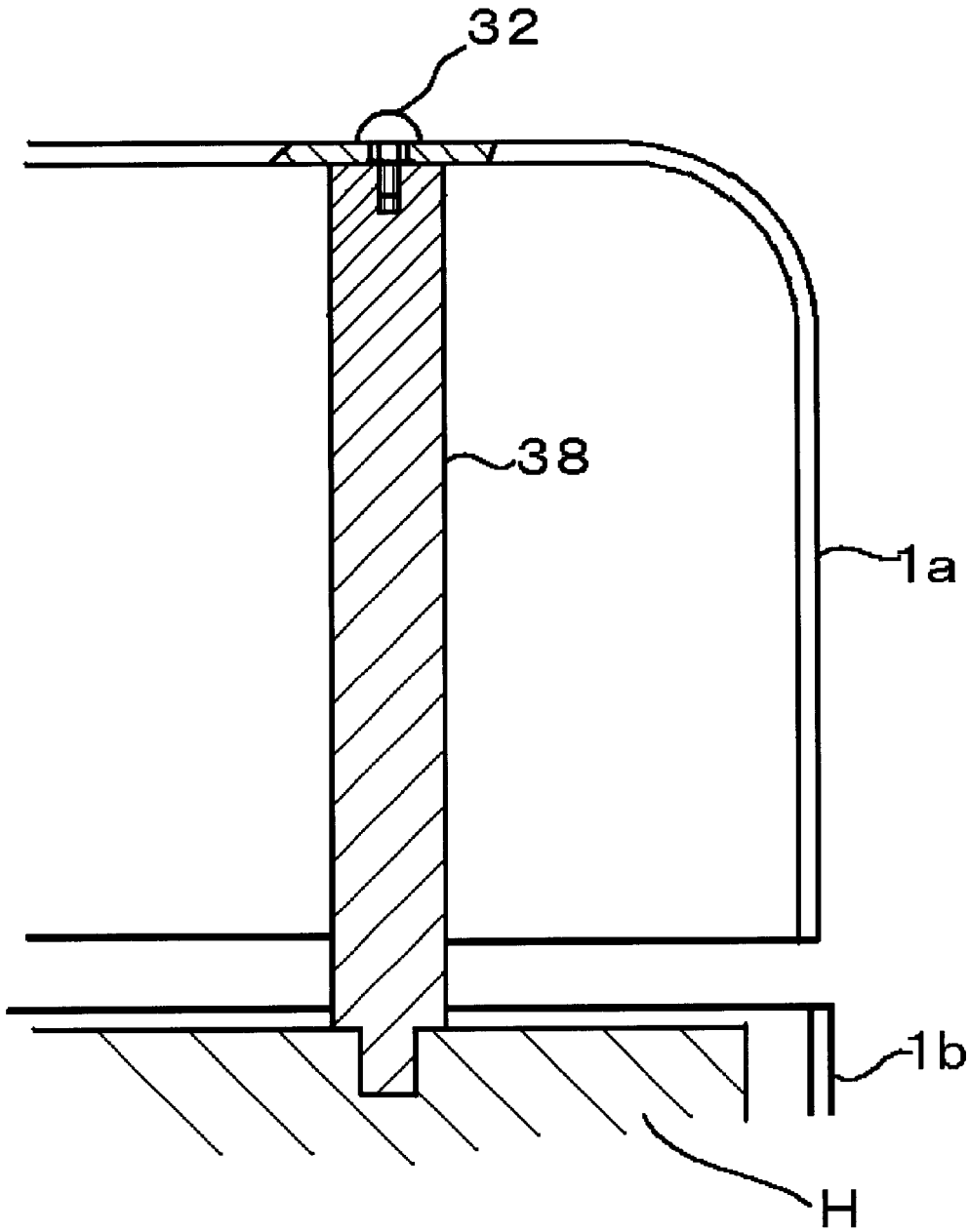
FIG. 6 is a side elevational view of another embodiment of a part the electric press shown in vertical section.

As shown in FIG. 6, the U-shaped frame 31 may replaced by a rigid shaft 38 which has a lower end secured to a body H to which the casing A is mounted and has an upper end to which the cover la is secured by a screw 32.

What is claimed is:

1. An electric press having a substantially airtight casing containing therein a drive device for reciprocatingly moving a ram relative to a work positioned on a base to press the work, and a device for exhausting the dusts produced within the casing from a room where the electric press is located to the outside into open air through a pipe connected to the casing, said electric press comprising dust exhausting means including at least two openings provided at the casing thereof, one of said openings being of a relatively small diameter to be used in connection with an exhauster of a normal level of exhausting ability and the other of the openings being of a relatively large diameter to be used in connection with an exhauster of a relatively low level of exhausting ability.

2. The electric press as defined in claim 1, further comprising change-over means for closing one of said openings when the other of said openings is used to exhaust the dusts within said casing.

3. The electric press as defined in claim 1, wherein said casing is divided into an upper portion and a lower portion, said upper portion being detachably mounted to said lower portion, and wherein said dust exhausting means includes a sealing sheet of a property preventing dusts from passing therethrough, said sealing sheet having one end secured to the inside of said upper portion of said casing such that the free end of said sealing sheet extends down into said lower portion of said casing all therearound to close a clearance between said upper portion and said lower portion, said sheet being yielding to the exhausting force of said exhauster to allow outer air to flow into said casing through said clearance when said exhauster is operated.

* * * * *